US006435236B2

(12) United States Patent
Gribovsky

(10) Patent No.: US 6,435,236 B2
(45) Date of Patent: Aug. 20, 2002

(54) MONEY CLIP

(75) Inventor: Vladimir Gribovsky, Mound, MN (US)

(73) Assignee: TPK, Inc., Waconia, MN (US)

( * ) Notice: Subject to any disclaimer, the term of this patent is extended or adjusted under 35 U.S.C. 154(b) by 0 days.

(21) Appl. No.: 09/790,325

(22) Filed: Feb. 22, 2001

Related U.S. Application Data

(60) Provisional application No. 60/184,098, filed on Feb. 22, 2000.

(51) Int. Cl.[7] ..... A45C 1/06
(52) U.S. Cl. ..... 150/137; 150/147; 150/138
(58) Field of Search ..... 24/327, 509, 564; 150/137, 147, 131, 138

(56) References Cited

U.S. PATENT DOCUMENTS

| | | | | | |
|---|---|---|---|---|---|
| 1,995,518 | A | * | 3/1935 | Perry | 150/147 |
| 2,686,545 | A | * | 8/1954 | Fontana | 150/137 |
| 2,779,461 | A | * | 1/1957 | Schweitzer | 150/137 |
| 2,785,722 | A | * | 3/1957 | Anderson | 150/137 |
| 2,816,590 | A | * | 12/1957 | Boots | 150/137 |
| D185,346 | S | * | 6/1959 | Chase | D3/247 |
| 3,299,929 | A | * | 1/1967 | Shagin et al. | 150/147 |
| 3,446,260 | A | * | 5/1969 | Osher | 150/147 |
| 3,454,069 | A | * | 7/1969 | Machler | 150/137 |
| 4,221,251 | A | | 9/1980 | Wagner | |
| 4,671,332 | A | | 6/1987 | McPhee | |
| 4,851,610 | A | * | 7/1989 | LeBlanc et al. | 150/147 X |
| 4,966,210 | A | | 10/1990 | Folkerstsma | |
| 5,199,573 | A | * | 4/1993 | Gribovsky | 206/579 |
| 5,263,523 | A | | 11/1993 | Scheunemann | |
| 5,653,276 | A | | 8/1997 | Niernberger | |
| 6,026,873 | A | * | 2/2000 | Van Geer | 150/147 |

* cited by examiner

*Primary Examiner*—Lee Young
*Assistant Examiner*—Tri M. Mai
(74) *Attorney, Agent, or Firm*—Patterson, Thuente, Skaar & Christensen, P.A.

(57) ABSTRACT

A money clip a first leaf, a second leaf, a spine and a clip. The first leaf has a first end and a second end. The first leaf includes a first main portion, an inner pocket and an outer pocket. The second leaf includes a second main portion, an inner pocket and an outer pocket. The inner pockets are attached to the first main portion and the second main portion to provide a first opening proximate the first end and a second opening proximate the second end. The outer pockets are attached to the second main portion to provide an opening proximate the first end. The spine is operably attached to the first ends of the first leaf and the second leaf. The clip is pivotally attached to the spine.

18 Claims, 2 Drawing Sheets

26
24
38
12
16
42
40
10
18
20
12
36
38

22
10
12
14
36
36
44
44

22
10
16

24
14
36
44
26
10
18
16
12
36
44

18
12
36
44
16
34
14
24
36
44
10

MONEY CLIP

RELATED U.S. APPLICATION DATA

This application claims priority to U.S. Provisional Application Serial No. 60/184,098, filed Feb. 22, 2000.

FIELD OF THE INVENTION

The present invention relates to devices for transporting personal belongings that may be worn in a pocket of clothing. More particularly, the present invention relates to a clipped device for holding folded currency bills.

BACKGROUND OF THE INVENTION

There are money clips known in the prior art. Such money clips typically had pockets having a rather short depth making the pockets ill-suited for carrying cards such as business cards, driver's licenses, and credit cards. Further, such money clips typically had only one or two pockets requiring that all cards carried be deposited in those pockets.

With the proliferation of cards being carried by individuals including a plurality of credit cards and automated teller machine cards, there is a need for a money clip having a number of different pockets so that the various types of cards can be organized by the user. Additionally, the leaves of the money clip should provide for greater depth of the pockets in order to better enclose the various cards.

Wagner, U.S. Pat. No. 4,221,251, discloses a billfold that is made from a sheet of material by folding the sheet of material along two perpendicular fold lines. The billfold also includes tabs that fold over to cover the currency and credit card compartments.

McPhee, U.S. Pat. No. 4,671,332, describes a wallet having a currency compartment and a credit card compartment. The wallet may be fabricated from a single strip of material. The wallet permits credit cards to be removed from the credit card compartment without opening the currency compartment.

Folkertsma, U.S. Pat. No. 4,966,210, teaches a wallet with a detachable billfold. The wallet includes two side members. One of the side members is adapted to receive the billfold. The other side member has a plurality of pockets for storing credit cards. The billfold includes a currency compartment and a plurality of slots for storing credit cards.

Scheunemann, U.S. Pat. No. 5,263,523, discloses a billfold having a central portion that is capable of receiving credit cards and a pair of side portions that fold over the central portion. The central portion includes a liner having a plurality of tabs to maintain the credit cards in a desired orientation.

Niernberger, U.S. Pat. No. 5,653,276, describes a wallet that includes a rectangular main body portion with a pocket formed therein. The wallet has a resilient clip for retaining currency next to a surface of the main body portion. The wallet also includes a pair of slots that are adapted to receive credit cards. The wallet further includes a flap that is foldable over the resilient clip and the slots to retain the currency and the credit cards in a fixed position.

Siegel, U.S. Pat. No. 5,775,398, teaches a wallet that is suited for holding a plurality of credit cards. The wallet has a pair of side portions to each is attached a credit card holding device. Each of the credit card holding devices is has a plurality of regions that are adapted to receive credit cards. The credit card holding devices are foldable upon each other to place the credit card holding device in a compact configuration. The regions each have a recess formed therein to facilitate removing the credit cards.

However, the prior art is deficient in that it does not teach or suggest a money clip that enables both currency and credit cards to be easily stored and accessed and that readily adjusts to accommodate different amounts of currency and credit cards to be stored therein.

SUMMARY OF THE INVENTION

The money clip of the present invention substantially meets the aforementioned needs of the industry. The money clip includes a first leaf, a second leaf, a spine and a clip.

The first leaf has a first end and a second end. The first leaf includes a first main portion, a first inner pocket and a first outer pocket. The first main portion has a first side and a second side. The first inner pocket is attached to the first side to provide a first opening proximate the first end and a second opening proximate the second end. The first outer pocket is attached to the second side to provide an opening proximate the first end.

The second leaf has a first end and a second end. The second leaf includes a second main portion, a second inner pocket and a second outer pocket. The second inner pocket is attached to the first side to provide openings proximate the first end and the second end. The second outer pocket is attached to the second side to provide an opening proximate the first end.

The spine is operably attached to the first ends of the first leaf and the second leaf. The clip is pivotally attached to the spine.

The leaves of the money clip are substantially lengthened in comparison to the prior art money clips such that the pockets attached thereto have considerably greater depth for better enclosing cards deposited therein. Additionally, there are four pockets, two outside pockets and two inside pockets so that the user of the money clip of the present invention may suitably organize the various types of cards being carried.

DETAILED DESCRIPTION OF THE PREFERRED EMBODIMENTS

Figure 1A:
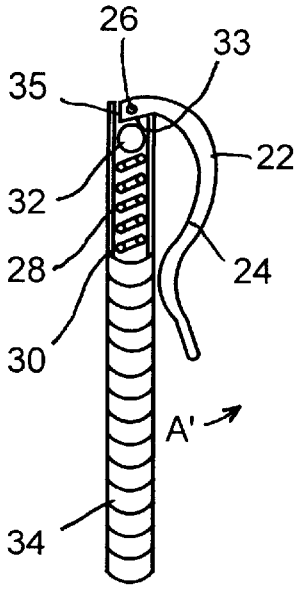
FIG. 1*a* is an elevational side view of the clip mechanism with the tube portion depicted in section.
Figure 1:
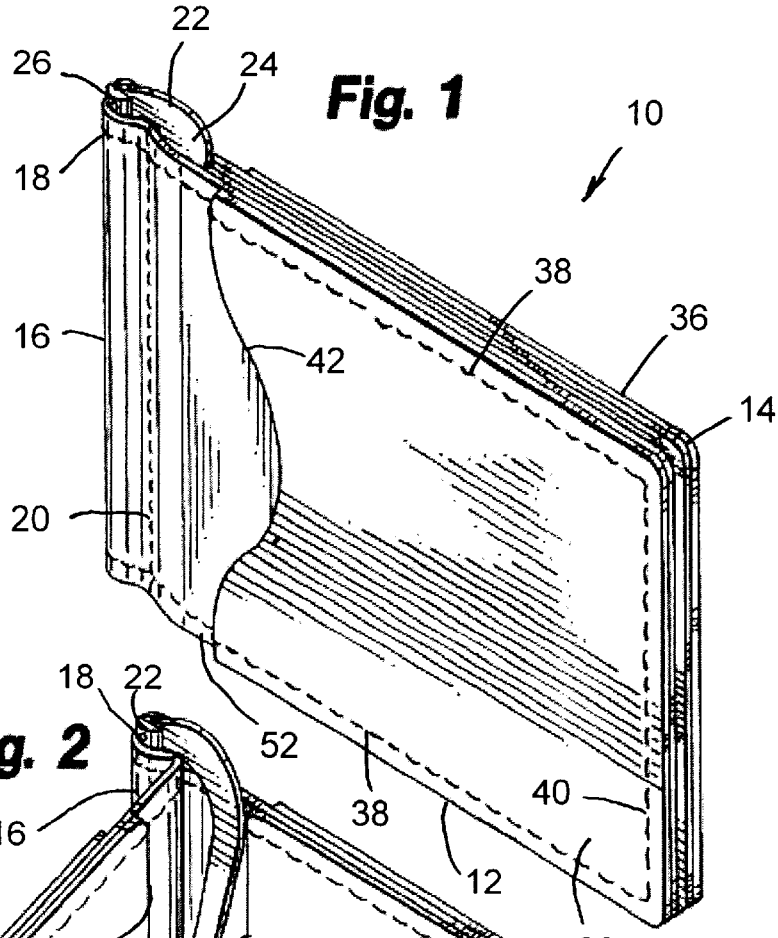
FIG. 1 is a perspective view with the present invention in its folded state.

The money clip of the present invention is shown generally at 10 in the figures. The money clip 10 has a first leaf 12 and a second leaf 14 hingedly joined at a spine 16.

The spine 16 has a loop 18 formed therein by stitches 20 that extend the width of the money clip 10. A clip mechanism 22 is slidably disposed within the loop 18.

The clip mechanism 22 has an arched clip 24 for retaining folded currency bills. At a proximal end, the arched clip 24 is hingedly coupled by a hinge 26 to a tube 28 as depicted in FIG. 1*a*. The tube 28 has a coil spring 30 disposed therein and a steel ball 32 interposed between the coil spring 30 and the proximal end of the arched clip 24. The tube 28 is fixedly coupled to a flexible ribbed body 34 that preferably generally conforms to the shape of a pocket of an article of clothing worn by a user when disposed therein.

The arched clip 24 is an over center device. The arched clip 24 is biased in the position depicted in FIGS. 1*a* and 2 by the ball 32 bearing on the underside 33 of the proximal end of the arched clip 24.

When the arched clip 24 is rotated away from the ribbed body 34 as indicated by the arrow A in FIG. 1*a*, the ball 32 engages the end margin 35 of the proximal end of the arched clip 24 when the arched clip 24 is disposed at approximately a right angle relative to the ribbed body 34. The arched clip 24 is held in this distended position by the action of the coil spring 30 bearing on the ball 32 to bias the arched clip 24 in such disposition. It should be noted that the clip mechanism 22 is readily removable from the loop 18 by merely sliding the tube 28 and attached ribbed body 34 from the loop 18.

Each of the first leaf 12 and second leaf 14 has an outer pocket 36 disposed thereon the outer margin of the outer pockets 36 are substantially coextensive with the outer margin of the respective leaves 12, 14. Each of the outer pockets 36 is closed on three sides, having stitched sides 38 and a stitched bottom 40. A generally curved opening 42 is defined proximate the spine 16.

Figure 2:
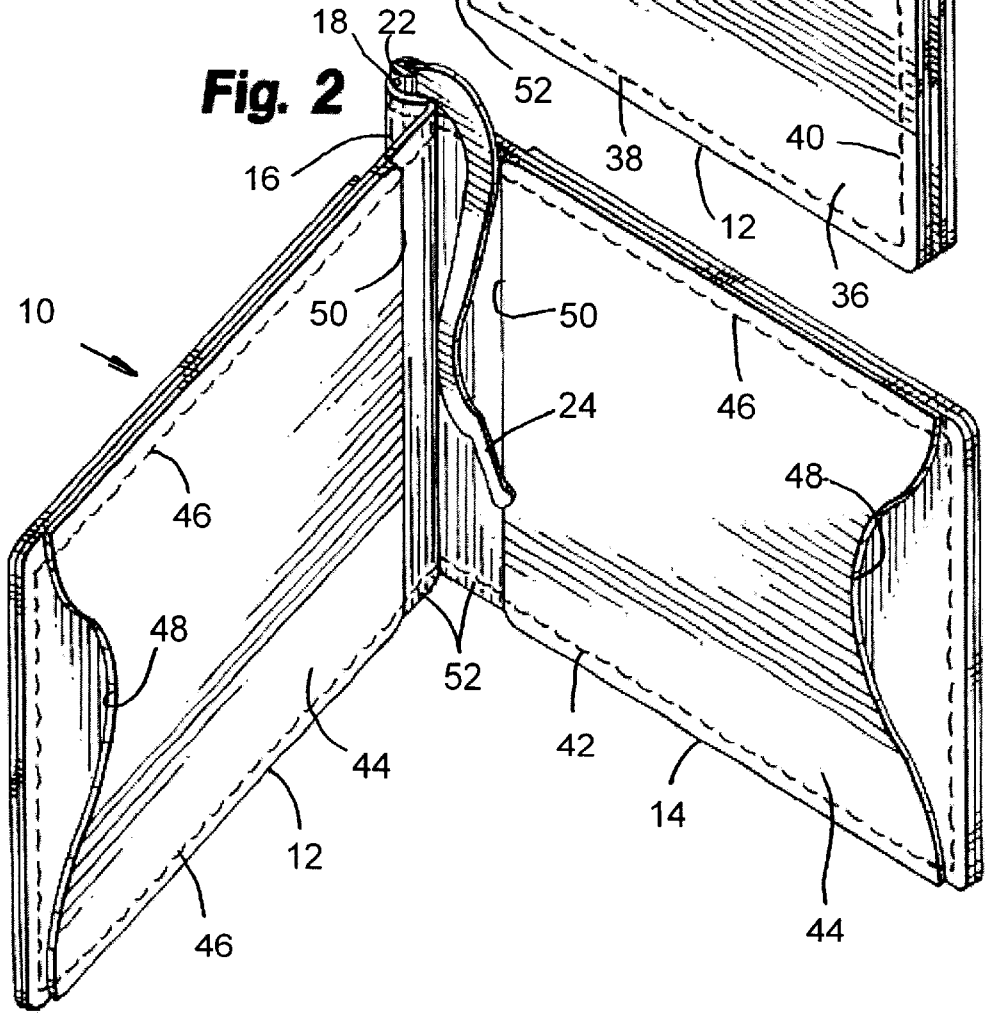
FIG. 2 is a perspective view thereof showing the design in its opened state.
Figure 3:
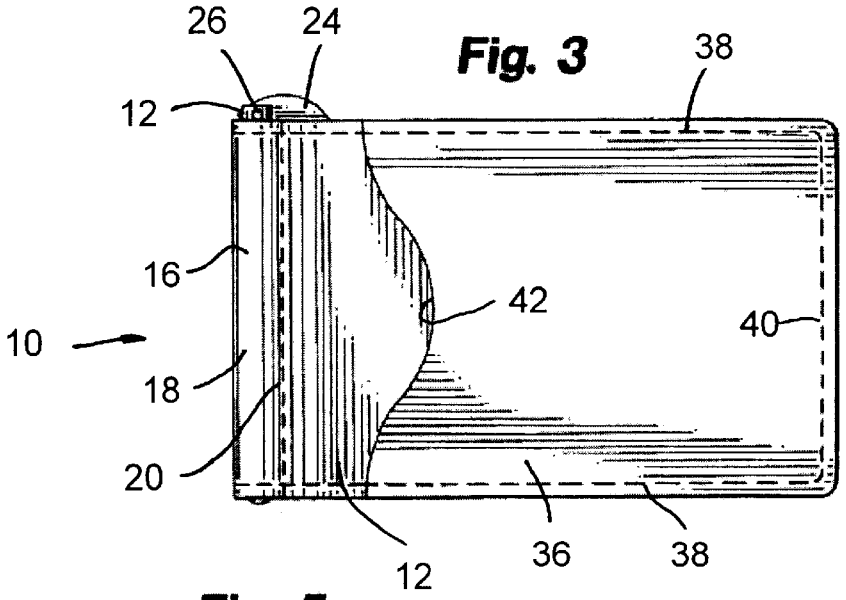
FIG. 3 is a front elevational view of the present invention in its folded state with the rear elevational view being a mirror image of the front elevational view.
Figure 4:
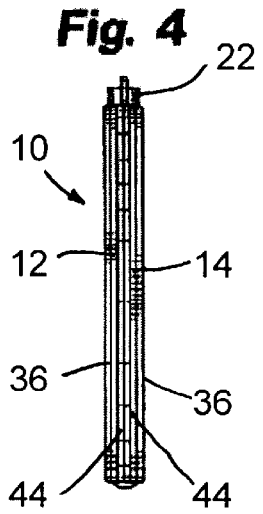
FIG. 4 is a left side elevational view, thereof.
Figure 5:
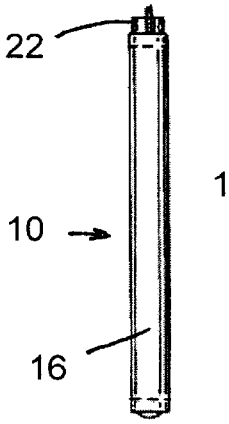
FIG. 5 is a right side elevational view, thereof.
Figure 6:
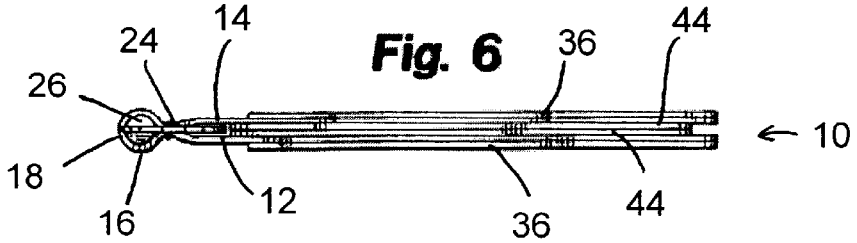
FIG. 6 is a top plan view, thereof.
Figure 7:
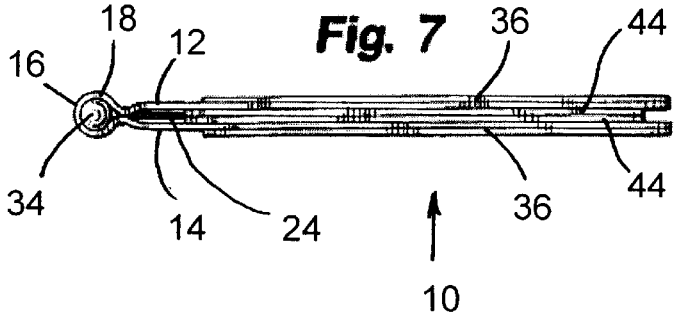
FIG. 7 is a bottom plan view.

Referring to FIG. 2, each of the first leaf 12 and the second leaf 14 additionally has an inner pocket 44. Each of the inner pockets 14 has stitched sides 46. The generally curved opening 48 is defined proximate, but no coextensive with, the end margin 49 of the respective first leaf 12 and second leaf 14. A second opening of the inner pocket 44 is the spine opening 50 located approximate the spine 16. Preferably, the spine opening 50 is a straight cut.

A neck 52, which is defined as a distance between the spine 16 and the outer/inner pockets 36, 44 approximately ⅜ of an inch. This neck length is approximately ¼ of an inch longer than in conventional wallets. Using the neck 52 with this length permits the first leaf 12 and the second leaf 14 to expand apart from each other to accommodate more credit cards while remaining in a substantially parallel relationship rather than flaring apart from each other.

The money clip 10 is preferably fabricated from a high grade leather material that is very thin. Additionally, the money clip 10 is unlined in the outer pockets 36 and the inner pockets 44. Nap on the inner surfaces of the outer pockets 36 and the inner pockets 44 prevents the credit cards from sliding out of the outer pockets 36 and the inner pockets 44.

Forming the inner pockets 44 with openings proximate the first end and the second end permits stuck items to be more readily removed from the inner pockets 44.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A money clip comprising:

a first leaf having a first end and a second end that are located opposite each other,
wherein the first leaf comprises:
a first main portion having a first side and a second side;
a first inner pocket attached to the first side such that the first inner pocket is not attached to the first main portion proximate the first end and the second end; and
a first outer pocket attached to the second side such that first outer pocket is not attached to the first main portion proximate the first end;

a second leaf having a first end and a second end, wherein the second leaf comprises:
a second main portion having a first side and a second side;
a second inner pocket attached to the first side such that the second inner pocket is not attached to the second main portion proximate the first end and the second end; and
a second outer pocket attached to the second side such that the second outer pocket is not attached to the second main portion proximate the first end;

a spine operably attached to the second ends of the first leaf; and a clip pivotally attached to the spine.

2. The money clip of claim 1, wherein the inner pockets on the first leaf and the second leaf are attached to the first main portion and the second main portion, respectively, along a top edge and a bottom edge.

3. The money clip of claim 1, wherein the outer pockets on the first leaf and the second leaf are attached to the first main portion and the second main portion, respectively, along the second end, a top edge and a bottom edge.

4. The money clip of claim 1, wherein the clip is biased towards the spine.

5. The money clip of claim 4, wherein spine has a tube that is adapted to receive a spring, and wherein clip is pivotally attached to the spine and wherein the spring operably engages the clip and pivots the clip to a closed position.

6. The money clip of claim 5, wherein the clip has an over-center configuration.

7. The money clip of claim 5, and further comprising a ball bearing operably mounted in the tube intermediate the spring and the clip.

8. The money clip of claim 1, wherein the clip has a proximal end, a distal end and an intermediate region intermediate the proximal end and the distal end, wherein the clip is operably attached to the spine proximate the proximal end, wherein the intermediate region is proximate the spine when the clip is in a closed position, and wherein the distal end is spaced apart from the spine when the clip is in the closed position.

9. The money clip of claim 1, wherein the first leaf, the second leaf, and the spine are fabricated from leather, cotton, polyester or combinations thereof.

10. A money clip comprising:

a first leaf having a first end and a second end that are located opposite each other,
wherein the first leaf comprises:
a first main portion having a first side and a second side;
a first inner pocket attached to the first side to provide a first opening proximate the first end and a second opening proximate the second end; and
a first outer pocket attached to the second side to provide an opening proximate the first end;

a second leaf having a first end and a second end, wherein the second leaf comprises:
a second main portion having a first side and a second side;

a second inner pocket attached to the first side to provide openings proximate the first end and the second end; and a second outer pocket attached to the second side to provide an opening proximate the first end;

a spine operably attached to the second ends of the first leaf and the second leaf; and a clip pivotally attached to the spine.

11. The money clip of claim 10, wherein the inner pockets on the first leaf and the second leaf are attached to the first main portion and the second main portion, respectively, along a top edge and a bottom edge.

12. The money clip of claim 10, wherein the outer pockets on the first leaf and the second leaf are attached to the first main portion and the second main portion, respectively, along the second end, a top edge and a bottom edge.

13. The money clip of claim 10, wherein the clip is biased towards the spine.

14. The money clip of claim 13, wherein spine has a tube that is adapted to receive a spring, and wherein clip is pivotally attached to the spine and wherein the spring operably engages the clip and pivots the clip to a closed position.

15. The money clip of claim 14, wherein the clip has an over-center configuration.

16. The money clip of claim 14, and further comprising a ball bearing operably mounted in the tube intermediate the spring and the clip.

17. The money clip of claim 10, wherein the clip has a proximal end, a distal end and an intermediate region intermediate the proximal end and the distal end, wherein the clip is operably attached to the spine proximate the proximal end, wherein the intermediate region is proximate the spine when the clip is in a closed position, and wherein the distal end is spaced apart from the spine when the clip is in the closed position.

18. The money clip of claim 10, wherein the first leaf, the second leaf, and the spine are fabricated from leather, cotton, polyester or combinations thereof.

* * * * *